10/15/85 OR 4,547,285

United States Patent [19]

Miller

[11] Patent Number: 4,547,285

[45] Date of Patent: Oct. 15, 1985

[54] HYDROTREATING PROCESS WHEREIN SULFUR IS ADDED TO THE FEEDSTOCK TO MAINTAIN THE CATALYST IN SULFIDED FORM

[75] Inventor: Robert E. Miller, Yorba Linda, Calif.

[73] Assignee: Union Oil Company of California, Los Angeles, Calif.

[21] Appl. No.: 544,826

[22] Filed: Oct. 24, 1983

[51] Int. Cl.[4] ..... C10G 45/04

[52] U.S. Cl. ..... 208/89; 208/85; 208/215; 208/216 R; 208/217; 208/210; 208/213; 208/254 H

[58] Field of Search ..... 208/89, 213, 216 R, 208/254 H, 254 R, 215, 85, 210

[56] References Cited

U.S. PATENT DOCUMENTS

| | | | |
|---|---|---|---|
| 2,790,751 | 4/1957 | Gerald | 208/253 X |
| 2,854,399 | 9/1958 | Weller | 208/88 |
| 2,914,470 | 11/1959 | Johnson et al. | 208/254 H |
| 3,094,480 | 6/1963 | Richardson | 208/254 |
| 3,140,994 | 7/1964 | Derr, Jr. et al. | 208/89 |
| 3,394,077 | 7/1968 | Kovach et al. | 208/254 H |
| 3,714,031 | 1/1973 | van der Toorn et al. | 208/113 |
| 3,904,511 | 9/1975 | Heiba et al. | 208/177 |
| 3,915,894 | 10/1975 | Clements et al. | 208/254 H |
| 3,926,784 | 12/1975 | Christman et al. | 208/210 |
| 4,108,761 | 8/1978 | Sze et al. | 208/254 H |
| 4,177,136 | 12/1979 | Herrington et al. | 208/216 R |
| 4,193,864 | 3/1980 | Chang | 208/210 |
| 4,342,641 | 8/1982 | Reif et al. | 208/89 |
| 4,414,102 | 11/1983 | Rankel et al. | 208/216 R |

*Primary Examiner*—D. E. Gantz
*Assistant Examiner*—Anthony McFarlane
*Attorney, Agent, or Firm*—Dean Sandford; Gregory F. Wirzbicki; Alan H. Thompson

[57] ABSTRACT

A catalytic hydrotreating process of a low sulfur-containing hydrocarbon oil involves the addition of sulfur to maintain the catalyst in a sulfided form.

28 Claims, No Drawings

HYDROTREATING PROCESS WHEREIN SULFUR IS ADDED TO THE FEEDSTOCK TO MAINTAIN THE CATALYST IN SULFIDED FORM

BACKGROUND OF THE INVENTION

1. Field of the Invention

This invention relates to a process for the catalytic conversion of hydrocarbons, and particularly to those processes involving the catalyzing of reaction of hydrogen with organic compounds containing nitrogen and/or sulfur so as to yield a denitrogenated and/or desulfurized product. More particularly, the invention is directed to the hydrodenitrogenation and/or hydrodesulfurization of hydrocarbon liquids. The invention is especially directed to the catalytic hydrotreating of shale oil containing low sulfur concentrations.

2. Description of the Prior Art

In the refining of liquid hydrocarbon oils derived from mineral oils and other sources, it is often desirable to subject the oil or fraction thereof to hydrotreating. Hydrotreating is a refining process wherein hydrocarbon oils are reacted with hydrogen. Hydrotreating is often employed to reduce the concentration of olefins and oxygen in hydrocarbons but is most commonly employed to reduce the concentration of nitrogen and/or sulfur. Reducing the concentration of nitrogen and sulfur produces a product hydrocarbon which, when eventually combusted, results in reduced air pollutants in the forms $NO_x$ and $SO_x$. Reducing the concentration of nitrogen is also desirable to protect other refining processes, such as hydrocracking, which employ catalysts which deactivate in the presence of nitrogen.

In general, the hydrotreating of a nitrogen and/or sulfur-containing hydrocarbon oil is carried out by contacting the oil with hydrogen at elevated temperatures and pressures and in the presence of a suitable catalyst so as to convert the nitrogen to ammonia and the sulfur to hydrogen sulfide.

A typical hydrotreating catalyst comprises particles containing a Group VIII active metal component and a Group VIB active metal component supported on a refractory oxide such as alumina. Phosphorus components are commonly incorporated into the catalyst to improve its activity by increasing its acidity. One catalyst which has been successfully employed on a commercial basis consists essentially of molybdenum, nickel, and phosphorus components, usually in their oxide forms, supported on gamma alumina. The metal oxides are then converted to sulfides, typically by contact at elevated temperatures with a hydrogen-hydrogen sulfide mixture or by contact with hydrogen and a hydrocarbon liquid containing organic sulfur compounds. Because of the problems inherent in the storage and transportation of sulfided catalyst, this final sulfiding step is usually carried out, not by the catalyst manufacturer, but by the catalyst user. Thus, the user normally purchases the catalyst in its oxide form, loads the catalyst into a hydrotreating reactor, and therein converts the catalyst metals to sulfides, either by contacting the catalyst with a specially prepared sulfiding mixture or by simply contacting the catalyst with hydrogen and an organic sulfur-containing feedstock. The resultant composition is a catalyst of high activity for hydrodenitrogenation and/or hydrodesulfurization under conventional hydrotreating conditions.

However, in some cases, hydrocarbon oils may contain such a relatively low concentration of sulfur that the sulfided form of the hydrotreating catalyst is difficult to maintain, especially when the catalyst is employed at relatively severe reaction conditions in order to treat difficult-to-remove nitrogen compounds.

Accordingly, it is a major object of this invention to provide a hydrotreating process, and particularly a hydrodenitrogenation and hydrodesulfurization catalytic process, which results in denitrogenation of a given hydrocarbon oil low in sulfur concentration.

It is another object of this invention to provide a catalytic process with excellent hydrodenitrogenation advantages, especially when utilizing a sulfided catalyst to remove organonitrogen compounds.

It is a further object of this invention to provide a catalytic process for hydrotreating a shale oil, particularly an upgraded shale oil, and more particularly, to provide a catalytic hydrodenitrogenation process of a shale oil.

It is a still further object of this invention to provide a catalytic process for hydrotreating a hydrocarbon oil that utilizes an inexpensive form of sulfur.

These and other objects and advantages of this invention will become apparent to those skilled in the relevant art in view of the following description of the invention.

SUMMARY OF THE INVENTION

Briefly, the invention relates to a process for catalytically hydrotreating a hydrocarbon oil wherein relatively small amounts of sulfur are added to the oil, usually prior to hydrotreating. In one embodiment, sulfur is added to a hydrocarbon oil containing less than about 0.2 weight percent of sulfur. In a preferred embodiment, shale oil containing less than about 0.06 weight percent of sulfur is denitrogenated in the presence of additional sulfur.

In a particularly preferred embodiment, a solid form of elemental sulfur is dissolved into an upgraded shale oil containing less than about 0.025 weight percent of sulfur and at least about 100 ppmw of nitrogen compounds. The upgraded shale oil, containing the additional sulfur to the extent of up to about 0.06 weight percent of the oil, is denitrogenated in the presence of hydrogen.

DETAILED DESCRIPTION OF THE INVENTION

The invention relates to a process for hydrotreating a hydrocarbon oil wherein sulfur is added to the oil prior to catalytic hydrotreating. A sulfur component is added to the oil such that the total concentration of sulfur that contacts a hydrotreating catalyst is maintained from about 0.002 to about 0.2 weight percent, calculated as S. Such a concentration of sulfur in the oil aids in maintaining the hydrogenation metal components on the hydrotreating catalyst in a sulfided form.

Any conventional hydrotreating catalyst may be employed to promote the reactions in the process of the invention. Porous refractory oxides useful in the present hydrotreating catalysts include, silica, magnesia, silica-magnesia, zirconia, silica-zirconia, titania, silica-titania, etc. Mixtures of the foregoing oxides are also contemplated, especially when prepared as homogeneously as possible. The preferred refractory oxide material, however, comprises alumina and, optionally, silica-alumina. When employed in the preparation of catalysts promoting hydrotreating reactions, such as hydrodenitrogenation, transition aluminas such as gamma alumina, delta alumina and theta alumina are highly preferred refractory oxides. It is most highly preferred that the porous refractory oxide contain at least about 90, and even more preferably at least about 95 percent of gamma alumina.

The support material is usually prepared in the form of shaped particulates by methods well known in the art, with the preferred method being to extrude a precursor of the desired support, as for example, an inorganic refractory oxide gel such as a peptized alumina gel prepared from comulled spray-dried powders, through a die having openings therein of desired size and shape, after which the extrudate is cut or broken into desired length and dried, usually at temperatures from about 100° F. to about 250° F. The particles usually have a symmetrical cross-sectional shape, and the average length of the particles is at least about twice that of the cross-sectional diameter. The cross-sectional diameter is herein considered as the longest dimension on the cross-section taken perpendicular to the longest axis of symmetry of the particle. Preferred refractory oxide particles have cross-sectional shapes that are cylindrical or have protrusions (lobes) from a central area, such as polylobes. The cross-sectional diameter of the particles is usually about 1/40 to about ¼ inch, preferably about 1/32 to about 1/12 inch, and most preferably about 1/24 to about 1/15 inch. Among the preferred refractory oxide particles, at least for hydrotreating, are those having cross-sectional shapes resembling that of a three-leaf clover, as shown, for example in FIGS. 8 and 8A of U.S. Pat. No. 4,028,227. Preferred clover-shaped particulates are such that each "leaf" of the cross-section is defined by about a 270° arc of a circle having a diameter between about 0.02 and 0.04 inch. Another preferred particulate has a tetralobal cross-sectional shape, as for example, when the lobes comprise arcs of circles of equal diameter having their centers at the vertices of a rhombus whose diagonals intersect at or near the center of the cross-section (i.e. assymetrical quadralobal cross-sectional shape).

Support particles prepared by the foregoing or equivalent procedures generally are precalcined, especially if gamma alumina is the chosen support material. Temperatures above about 900° F. are usually required to convert alumina gel or hydrated alumina particulates to gamma alumina. Typically, temperatures between about 1,000° F. and 1,500° F. are utilized to effect this transformation, with holding periods of ¼ to 3 hours generally being effective.

Physical characteristics of the hydrotreating catalyst include a pore size distribution wherein at least about 50 percent of the total pore volume is in pores of diameter distributed over a range from about 50 to about 200 angstroms, as determined by conventional mercury porosimeter testing methods. Oftentimes, the support particles have a pore size distribution including at least 60, and preferably 70 percent of the total pore volume in pores of diameter from about 60 to about 90 angstroms.

Other characteristics of the catalyst include a total pore volume, as measured by the conventional mercury/helium differential density method, that is usually about 0.25 to about 1.0 cc/gram, preferably about 0.30 to about 0.70 cc/gram and most preferably about 0.30 to about 0.50 cc/gram. The mode pore diameter of the catalyst is usually greater than about 50 angstroms and preferably from about 60 to about 80 angstroms. As used herein, the term "mode pore diameter" is that pore diameter above which 50 percent of the total pore volume is contained and below which 50 percent of the total pore volume is contained. Additionally, the surface area (as measured by the B.E.T. method) of the catalyst is above about 100 $m^2$/gram, usually from about 100 $m^2$/gram to about 400 $m^2$/gram and preferably about 125 $m^2$/gram to about 250 $m^2$/gram.

The hydrotreating catalyst ordinarily contains at least one active metal hydrogenation component and usually comprises about 10 to about 35 weight percent of Group VIB components (calculated as the trioxide), about 1 to about 6 weight percent of Group VIII components (calculated as the monoxide) and about 1 to about 6 weight percent of phosphorus components (calculated as elemental phosphorus). In a preferred catalyst containing nickel and molybdenum, the weight ratio of nickel components, as nickel oxide to molybdenum components, as molybdenum trioxide, is between about 0.15:1 and about 0.20:1, and the weight ratio of phosphorus components, as elemental phosphorus, to nickel components, as nickel oxide, is between about 0.5:1 and about 1:1.

A highly preferred catalyst employed in the process of the invention contains about 2 to about 6 weight percent of Group VIII metal components, calculated as the monoxide, from about 17 to about 35 weight percent of Group VIB metal components, calculated as the trioxide and about 2 to about 6 weight percent of phosphorus components, calculated as P, on a porous refractory oxide support comprising gamma alumina and having a trilobal or assymetrical quadralobal cross-sectional shape. The most preferred Group VIII and Group VIB metals in this embodiment are nickel and molybdenum, respectively. Physical characteristics of this catalyst include a total pore volume of about 0.25 to about 0.50 cc/gram, a surface area from about 125 to about 225 $m^2$/gram and a mode pore diameter from about 60 to about 90 angstroms.

The hydrotreating catalyst is usually employed in accordance with the invention as either a fixed or fluidized bed of particulates in a suitable reactor vessel wherein the hydrocarbon oil to be treated is introduced and subjected to elevated conditions of pressure and temperature, and a substantial hydrogen partial pressure, so as to effect the desired degree of conversion of, for example, organosulfur compounds to hydrogen sulfide and organonitrogen compounds to ammonia. Most usually, the catalyst is maintained as a fixed bed with the hydrocarbon oil passing downward therethrough, and the reactor is generally operated under conditions selected from those shown in the following TABLE I:

TABLE I

| Operating Conditions | Suitable Range | Preferred Range |
|---|---|---|
| Temperature, °F. | 500-900 | 600-850 |
| Hydrogen Pressure, p.s.i.g. | 100-3,000 | 500-2,000 |
| Space Velocity, LHSV | 0.05-5.0 | 0.1-3.0 |
| Hydrogen Recycle Rate, scf/bbl | 500-15,000 | 1,000-10,000 |

Typically, the particulate catalyst is more active, sometimes far more active, in a sulfided form than in an oxide form in which it is generally prepared. Accordingly, after calcination, a catalyst is sulfided prior to use (in which case the procedure is termed "presulfiding") by passing a sulfiding gas or sulfur-containing hydrocarbon oil over the catalyst prepared in the calcined form.

Ordinarily, a mixture of hydrogen and one or more components selected from the group consisting of sulfur vapor and the sulfur compounds (e.g., lower molecular weight thiols, organic sulfides and especially $H_2S$) is suitable for presulfiding the catalyst. Generally speaking, the relative proportion of hydrogen in the presulfiding mixture is not critical, with any proportion of hydrogen ranging from 1 to 99 percent by volume being adequate. Although it is preferred that a complete presulfiding procedure be employed, one may, as an alternative, accomplish the sulfiding in situ, particularly since the catalyst contacts a hydrocarbon oil that contains additional sulfur during the process of the invention.

Typical hydrocarbon oils suitable for treatment herein are light and heavy gas oils, cycle oils, naphthas, kerosene, turbine fuels, diesel fuels, oils from bituminous sands, coal compositions and synthetic crudes such as shale oils, liquid hydrocarbons obtained from coal compositions or from bituminous sands. The preferred oils are shale oils, and in particular, upgraded shale oils, especially those containing organonitrogen components and relatively low concentrations of sulfur components. It is highly preferred that the hydrocarbon oil have the capability of dissolving elemental sulfur, preferably solid elemental sulfur, to the extent of at least about 0.01 weight percent, generally at least about 0.06, often at least about 0.1 and frequently at least about 0.2 weight percent of the hydrocarbon oil.

Upgraded shale oils suitable for treatment herein include a full boiling range shale oil that has been successively deashed, as by filtration or electrostatic agglomeration, dearsenated, as by the process described in U.S. Pat. No. 4,046,674, herein incorporated by reference in its entirety, and catalytically hydrotreated. When such a sequential deashing-dearsenatinghydrotreating method is applied to shale oils derived by retorting oil shale such as that found in a Colorado River formation a adjacent areas, the upgraded shale oil will typically have a boiling point range between about 80 and about 1,030° F., preferably about 500° F. to about 1,030° F., an organonitrogen content between about 20 and 3,500 wppm, usually between about 30 and 2,000 wppm, an organosulfur content between about 10 and 2,000 wppm, usually between about 35 and 100 wppm, a pour point above about 50° F., usually about 75° and 90° F., and an arsenic content less than about 1 wppm. A highly preferred upgraded shale oil suitable for treatment herein is a raw Colorado shale oil which has been successively deashed, dearsenated, hydrotreated and hydrodewaxed, for example, by the method described in U.S. patent application Ser. No. 267,247, filed May 26, 1981, now U.S. Pat. No. 4,428,862, herein incorporated by reference in its entirety. The most highly preferred upgraded shale oils are those which have been deashed-dearsenated hydrotreated-hydrodewaxed, followed by distillation to recover the 500° F. to 1,030° F. boiling fraction. Such upgraded shale oils have an organosulfur content less than about 250 ppmw, an organonitrogen content greater than about 100 ppmw and an arsenic content less than about 1 ppmw.

In general, a hydrocarbon oil to be treated by contact with the catalyst described herein contains less than about 0.2 weight percent of sulfur components (calculated as sulfur), usually less than about 0.1 weight percent, often less than about 0.06 weight percent and frequently less than about 0.01 weight percent. Furthermore, the oil contains at least 30 ppmw, and preferably at least 100 ppmw nitrogen components (calculated as nitrogen), and usually between about 10 and about 5,000 ppmw of nitrogen components. Ordinarily, an upgraded shale oil hydrotreated by the process of the invention contains less than 0.06, and often less than 0.01 weight percent sulfur and at least 50, and often at least 100 ppmw nitrogen. The nitrogen components and the sulfur components are generally present in the hydrocarbon oil essentially completely in the form of organonitrogen and organosulfur compounds, respectively. Also, the hydrocarbon oil usually contains contaminant metals, such as nickel, vanadium and iron, in a total concentration low enough to prevent significant catalyst deactivation and usually less than about 15 ppmw, preferably less than about 10 ppmw, more preferably less than about 5 ppmw and, in the case of some shale oils, less than about 2 ppmw.

An essential feature of the present invention is that at least one sulfur component is added to a hydrocarbon oil usually prior to the oil contacting the hydrotreating catalyst at hydrotreating conditions. The amount of sulfur added to the oil varies depending upon such factors as the amount of sulfur in the oil prior to sulfur addition, and/or the amount of sulfur required to maintain, at least in part, sulfided metal components on the hydrotreating catalyst. However, a sulfur component is added to the oil in a concentration such that the total concentration of sulfur in the oil that contacts the catalyst under hydrotreating conditions is less than about 0.2 weight percent, often less than about 0.1 weight percent and more often less than about 0.6 weight percent, calculated as S. After addition of the sulfur to the oil, the oil contacts the catalyst under reaction conditions and contains sulfur during the contacting period in a total concentration generally from about 0.002 to about 0.2 weight percent, more particularly from about 0.01 to about 0.1 weight percent and most usually from about 0.025 to about 0.06 weight percent of the hydrocarbon oil feedstock.

The sulfur component may be introduced into the hydrocarbon oil in any suitable form including elemental (i.e. free) sulfur, hydrogen sulfide, dimethyl sulfide, dimethyl disulfide, thiophene, carbon disulfide, mercaptans and other sulfur compounds, and conveniently is commingled with the hydrocarbon oil prior to introducing the oil into the hydrotreating reaction zone. However, the sulfur may on occasion be supplied directly into the reaction zone in a suitable manner. In a preferred embodiment, elemental sulfur, either in solid or liquid form, is introduced by suitable means into a hydrogen recycle gas stream that itself is introduced into a hydrocarbon oil feedstock upstream of the reaction zone. In another embodiment, solid elemental sulfur is introduced directly into the hydrocarbon oil feedstock prior to its introduction into the reaction zone. The solid sulfur is conveniently employed in crushed or pelletized form, such as rhombic sulfur particulates disclosed in U.S. Pat. No. 3,637,351, herein incorporated in its entirety by reference, and is especially conveniently utilized in commercial refinery operations where there is poor availability of sulfur at the refinery site and a safe, transportable form of inexpensive solid sulfur is preferred.

One unique feature of the invention is that as a result of the addition of such relatively small amounts of sulfur to the low sulfur-containing hydrocarbon oils, the hydrotreating catalyst, in its fully or partially sulfided form, is still capable of promoting the reaction of organonitrogen compounds in the oil under typical hydrotreating conditions. At least 60 percent, preferably at least 75 percent, and most preferably at least 90 percent of the organonitrogen compounds in the hydrocarbon oil are converted to removable nitrogen compounds, such as ammonia. Ordinarily, such conversions result in effluent hydrocarbon feedstocks containing less than about 100 ppmw, frequently less than about 30 ppmw and preferably less than about 10 ppmw of total nitrogen components, calculated as N. A substantial proportion of such effluent hydrocarbon feedstocks may subsequently undergo further refining such as cracking and hydrocracking wherein the catalysts contain materials that are susceptible to deactivation in the presence of organonitrogen compounds The invention is further illustrated by the following examples which are illustrative of specific modes of practicing the invention and are not intended as limiting the scope of the invention as defined in the appended claims.

EXAMPLE

A commercially available hydrotreating catalyst is tested under typical hydrotreating conditions with an upgraded shale oil. The commercial catalyst, having a 1/20 inch assymetrical quadralobal cross-sectional shape, has a pore size distribution with at least 50 percent of the pores being of diameter from about 50 to about 90 angstroms and a mode pore diameter about 70 angstroms. The catalyst has a nominal composition of 25.0 weight percent of molybdenum components, calculated as $MoO_3$, 4.0 weight percent of nickel components, calculated as NiO, 3.2 weight percent of phosphorus, calculated as P, and the balance of gamma alumina.

Two hundred and fifty (250) grams of the catalyst are loaded into a hydrotreating reactor and presulfided for about 16 to about 20 hours by contact with a gas consisting of 90 volume percent $H_2$ and 10 volume percent $H_2S$ flowing at 4.4 SCFH at one atmosphere pressure. The temperature during the presulfiding is initially at room temperature, is increased gradually until 700° F. is reached, and then lowered to 550° F., at which time the catalyst is contacted with the feedstock.

The hydrotreating catalyst is then tested to determine the hydrodenitrogenation activity. The presulfided catalyst is charged to a reactor and utilized at 755° F. to hydrodenitrogenate upgraded shale oil feedstock having the characteristics shown in Table I below under the following conditions: 2000 p.s.i.g. total pressure, 1.4 LHSV and hydrogen rate of 5,500 scf/bbl.

TABLE I

| FEEDSTOCK PROPERTIES | |
|---|---|
| Feed Description | Shale Oil |
| Sulfur, ppmw | 21 |
| Nitrogen, ppmw | 160 |
| Nickel and Vanadium, ppmw | <1 |
| Viscosity at 100, CST | 21.89 |
| Viscosity at 210, CST | 4.069 |
| Pour Point, °F. | +75 |
| Analine Point, °F. | 202 |
| Gravity, °API | 30.5 |
| Distillation, D-1160, °F. | |
| IBP/5 | 606/658 |
| 10/20 | 670/688 |
| 30/40 | 706/727 |
| 50/60 | 756/783 |
| 70/80 | 814/842 |
| 90/95 | 890/926 |

TABLE I-continued

| FEEDSTOCK PROPERTIES | |
|---|---|
| Feed Description | Shale Oil |
| EP/% Rec | 970/99.0 |
| Hydrocarbon Types, wt % | |
| Paraffins | 27.0 |
| Mononaphthenes | 22.4 |
| Polynaphthenes | 24.2 |
| Monoaromatics | 17.3 |
| Diaromatics | 3.9 |
| Triaromatics | 3.3 |
| Tetraaromatics | 0.3 |
| Pentaaromatics | 1.6 |

Sulfur, in the form of liquid thiophene, is injected into the feedstock in a concentration of 265 ppmw and then the feedstock is passed downwardly through a reactor and contacted with the described catalyst in a single-stage, single-pass system with once-through hydrogen such that the effluent nitrogen concentration is maintained at about 10 ppmw, equivalent to about 94 percent denitrogenation.

While particular embodiments of the invention have been described, it will be understood, of course, that the invention is not limited thereto since many obvious modifications can be made, and it is intended to include within this invention any such modifications as will fall within the scope of the invention as defined by the appended claims.

I claim:

1. A process for hydrotreating a hydrocarbon oil containing less than about 0.1 weight percent of total sulfur, calculated as S, under reaction conditions with a hydrotreating catalyst, said process comprising adding a sulfur component to said hydrocarbon oil during said hydrotreating in a concentration such that the total concentration of sulfur contacting said hydrotreating catalyst during said hydrotreating is maintained at about 0.01 to about 0.1 weight percent, calculated as S.

2. The process defined in claim 1 wherein said hydrotreating removes nitrogen from said hydrocarbon oil.

3. The process defined in claim 1 wherein said hydrocarbon oil contains less than about 15 ppmw of total contaminant metals, calculated as the free metal.

4. The process defined in claim 1 further comprising cracking a substantial proportion of the effluent hydrocarbon oil from said hydrotreating.

5. The process defined in claim 1 wherein said total concentration of sulfur contacting said hydrotreating catalyst is between about 0.025 and about 0.06 weight percent.

6. The process defined in claim 1 wherein said hydrocarbon oil comprises a synthetic crude.

7. The process defined in claim 1 wherein said sulfur component is selected from the group consisting of hydrogen sulfide, dimethyl sulfide, dimethyl disulfide, thiophene, carbon disulfide, mercaptan and elemental sulfur.

8. The process defined in claim 1 wherein said sulfur component is elemental sulfur in a solid form immediately prior to addition to said hydrocarbon oil.

9. The process defined in claim 1 wherein said hydrotreating catalyst comprises active metal hydrogenation components in a sulfided form.

10. The process defined in claim 9 wherein said active metal hydrotreating components are selected from the group consisting of Group VIB and Group VIII metals.

11. The process defined in claim 1 wherein said hydrocarbon oil contains less than about 0.01 weight percent of sulfur prior to said sulfur component addition.

12. The process defined in claim 1 wherein said hydrocarbon oil is an upgraded shale oil containing less than about 0.06 weight percent of sulfur prior to said sulfur component addition.

13. The process defined in claim 1 wherein said hydrocarbon oil comprises a full boiling range shale oil that has been successively deashed, dearsenated and hydrotreated.

14. A process for hydrodenitrogenating a hydrocarbon oil containing greater than about 30 ppmw of total nitrogen, calculated as N, less than about 0.10 weight percent of total sulfur, calculated as S, and less than about 10 ppmw of total contaminant metals, calculated as the free metals, under reaction conditions with a hydrodenitrogenation catalyst, said process comprising adding a sulfur component to said hydrocarbon oil during said hydrodenitrogenating in a concentration such that the total concentration of sulfur contacting said hydrodenitrogenation catalyst during said hydrodenitrogenating is maintained at about 0.01 to about 0.10 weight percent, calculated as S.

15. The process defined in claim 14 wherein said hydrocarbon oil comprises at least one member selected from the group comprising a shale oil, an upgraded shale oil, an oil from bituminous sands and a liquid hydrocarbon obtained from a coal composition.

16. The process defined in claim 14 wherein said sulfur component is selected from the group consisting of hydrogen sulfide, dimethyl sulfide, dimethyl disulfide, thiophene, carbon disulfide, mercaptan and elemental sulfur.

17. The process defined in claim 14 wherein said sulfur component is elemental sulfur in a solid form immediately prior to addition to said hydrocarbon oil.

18. The process defined in claim 14 wherein said hydrodenitrogenation catalyst comprises hydrogention components selected from the group consisting of Group VIB and Group VIII metal components in a sulfided form.

19. The process defined in claim 18 wherein said total concentration of sulfur contacting said denitrogenation catalyst is between about 0.02 and about 0.06 weight percent.

20. The process defined in claim 18 wherein said active metal components comprise nickel or cobalt and molybdenum or tungsten.

21. The process defined in claim 14 wherein said hydrocarbon oil comprises a full boiling range shale oil that has been successively deashed, dearsenated and hydrotreated.

22. A process for hydrodenitrogenating an upgraded shale oil containing greater than about 100 ppmw of total nitrogen, calculated as N, less than about 0.025 weight percent of sulfur, calculated as S, and less than about 5 ppmw of total contaminant metals, calculated as the free metals, under reaction conditions with a hydrodenitrogenation catalyst, said process comprising adding elemental sulfur to said upgraded shale oil during said hydrodenitrogenating in a concentration such that the total concentration of sulfur contacting said hydrodenitrogenation catalyst during said hydrodenitrogenating is maintained at about 0.025 to about 0.06 weight percent, calculated as S.

23. The process defined in claim 22 wherein said hydrodenitrogenation calalyst comprises hydrogenation components selected from the the group consisting of Group VIB and Group VIII metal components in a sulfided form.

24. The process defined in claim 22 wherein said elemental sulfur is in a solid form immediately prior to addition to said upgraded shale oil.

25. The process defined in claim 23 wherein said hydrodenitrogenation catalyst further comprises phosphorus components and said Group VIB and Group VIII metal components are selected from the group consisting of nickel, cobalt, molybdenum and tungsten.

26. The process defined in claim 23 wherein said upgraded shale oil contains less than about 0.01 weight percent of said sulfur prior to said sulfur addition.

27. The process defined in claim 23 wherein said upgraded shale oil contains less than about 2 ppmw of total contaminant metals.

28. The process defined in claim 23 wherein said upgraded shale oil has been successively deashed, dearsenated and hydrotreated.

* * * * *